United States Patent [19]

Passmore et al.

[11] Patent Number: 5,021,703

[45] Date of Patent: Jun. 4, 1991

[54] METAL HALIDE LAMP

[75] Inventors: Edmund M. Passmore, Gloucester; William M. Keeffe, Rockport, both of Mass.

[73] Assignee: GTE Products Corporation, Danvers, Mass.

[21] Appl. No.: 361,884

[22] Filed: Jun. 6, 1989

[51] Int. Cl.[5] ..... H01J 61/12; H01J 61/20

[52] U.S. Cl. ..... 313/25; 313/571; 313/639

[58] Field of Search ..... 313/25, 638, 639, 571

[56] References Cited

U.S. PATENT DOCUMENTS

| | | | |
|---|---|---|---|
| 2,103,038 | 12/1937 | Moers | 313/639 |
| 3,364,376 | 1/1968 | Collins et al. | 313/579 |
| 3,728,572 | 4/1973 | Maier et al. | 313/579 |
| 4,163,171 | 7/1979 | Wurster | 313/579 |
| 4,171,498 | 10/1979 | Fromm et al. | 313/641 |
| 4,620,125 | 10/1986 | Keeffe et al. | 313/25 |
| 4,625,141 | 11/1986 | Keeffe et al. | 313/25 |
| 4,709,184 | 11/1987 | Keeffe et al. | 313/25 |
| 4,791,334 | 12/1988 | Keeffe et al. | 313/25 |

*Primary Examiner*—Sandra L. O'Shea

*Attorney, Agent, or Firm*—Martha Ann Finnegan

[57] ABSTRACT

A metal halide high intensity discharge lamp including a carbon monoxide additive in the arc tube fill to improve lumen maintenance is provided. The metal halide discharge lamp of the present invention comprises: an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors such that one electrode is electrically connected to one electrical conductor; a chemical fill disposed within the arc tube, the chemical fill comprising mercury, metal halide additives, carbon monoxide, and a starting gas; and a support structure disposed within the outer glass envelope to support the arc tube therein.

9 Claims, 2 Drawing Sheets

METAL HALIDE LAMP

TECHNICAL FIELD OF THE INVENTION

This invention relates to metal halide lamps, and more particularly to metal halide high intensity discharge lamps having improved lumen maintenance.

BACKGROUND OF THE INVENTION

While the addition of carbon monoxide to the fill gas of incandescent lamps is shown to be beneficial to the performance of such lamps (see, for example, U.S. Pat. Nos. 3,728,572 and 3,364,376, and 4,163,171), it has heretofore been generally believed in the lighting field that the presence of elemental carbon and oxygen in the arc tube fill of metal halide high intensity discharge (HID) lamps degrades lamp performance. Carbon has been viewed as a harmful impurity which forms deposits on the arc tube walls thereby causing the light output of the lamp to diminish. Further, elemental oxygen has been viewed as an undesired fill component which reacts with the radiating species of the fill gas to form stable metal oxides. Such removal of radiating species from the fill gas degrades the radiation spectrum of the lamp.

Because of the significant and substantial differences between the chemistries of incandescent and metal halide HID lamps, the use of carbon monoxide in incandescent lamps does not and would not suggest that the addition of carbon monoxide to the arc tube fill of metal halide HID lamps would be useful.

The differences between the chemistries of incandescent and metal halide HID lamps are borne out by the following. Mercury, for example, is not useful in tungsten halogen incandescent lamps. Mercury will react with gaseous iodine present in the fill of such lamps to form solid mercury iodide compounds, thereby removing iodine from the regenerative cycle of the lamp. Mercury, on the other hand, is a typical component of the arc tube fill of a metal halide HID lamp. The mercury in metal halide HID lamps forms condensed mercury iodide compounds. Such condensed mercury iodide compounds are unique to metal halide HID lamps, and emphasize the distinction between metal halide HID lamps and incandescent types. An example of another metal which is known to be useful in metal halide HID lamps and not useful in incandescent lamps is sodium. While sodium is present in the fill of a large majority of metal halide HID lamps, sodium is known to adversely affect the regenerative cycle of the tungsten halogen incandescent type lamp. See, for example, U.S. Pat. No. 4,163,171.

SUMMARY OF THE INVENTION

In accordance with the present invention it has been unexpectedly found that inclusion of the elements carbon and oxygen in the form of carbon monoxide in the chemical fill of a metal halide lamp improves the performance of such lamps. The metal halide discharge lamp of the present invention comprises: an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors such that one electrode is electrically connected to one electrical conductor; a chemical fill disposed within the arc tube, the chemical fill comprising mercury, metal halide additives such as sodium and scandium, carbon monoxide, and a starting gas; and a support structure disposed within the outer glass envelope to support the arc tube therein.

For a better understanding of the present invention, together with other and further advantages and capabilities thereof, reference is made to the following in conjunction with the accompanying drawings.

DETAILED DESCRIPTION

The present invention is directed to a metal halide discharge lamp having improved lamp performance. The metal halide discharge lamp of the present invention comprises: an outer sealed glass envelope; a pair of electrical conductors sealed into and passing through the glass envelope; an arc tube disposed within the outer glass envelope, the arc tube including a pair of spaced electrodes therein with the electrodes being electrically connected to the electrical conductors such that one electrode is electrically connected to one electrical conductor, a chemical fill disposed within the arc tube, the chemical fill comprising mercury, metal halide additives, carbon monoxide, and a starting gas; and a support structure disposed within the outer glass envelope to support the arc tube therein.

Examples of metal halide additives included in the chemical fill of the lamp are sodium halide, cesium halide, scandium halide, lithium halide, thorium halide, rare earth halides including dysprosium halide and holmium halide. Such metal halide additives are typically included in the fill as iodides. The fill may further include thorium and/or scandium metal.

The carbon monoxide additive included in the chemical fill of the lamp of the present invention is preferably included in an amount greater than zero (0) and less than or equal to approximately 0.5 percent by volume. Most preferably, the carbon monoxide additive is included in the fill in an amount from approximately 0.1 to 0.2 percent by volume.

The present invention is particularly advantageous for low wattage type metal halide discharge lamps, i.e., those lamps with a wattage less than 175 watts.

For a low wattage metal halide discharge lamp in accordance having a lamp wattage less than 175 watts, e.g., 40 to 150 watts, the scandium metal weight dosage is preferably from about 90 to 110 micrograms per cubic centimeter of arc tube volume.

The mercury dosage in the chemical fill of a lamp in accordance with the present invention is preferably determined in accordance with the formula:

$$N(Hg)\ (mg/cm^3) = 7.7D^{1/7}$$

wherein D is the arc tube diameter in millimeters.

Preferably, the molar ratio of sodium iodide to scandium iodide in the chemical fill is in the range of about 20:1 to 28:1 in order to obtain a desired color temperature and high luminous efficacy. See U.S. Pat. No. 4,709,184, the disclosure of which is hereby incorporated herein by reference.

Figure 1:
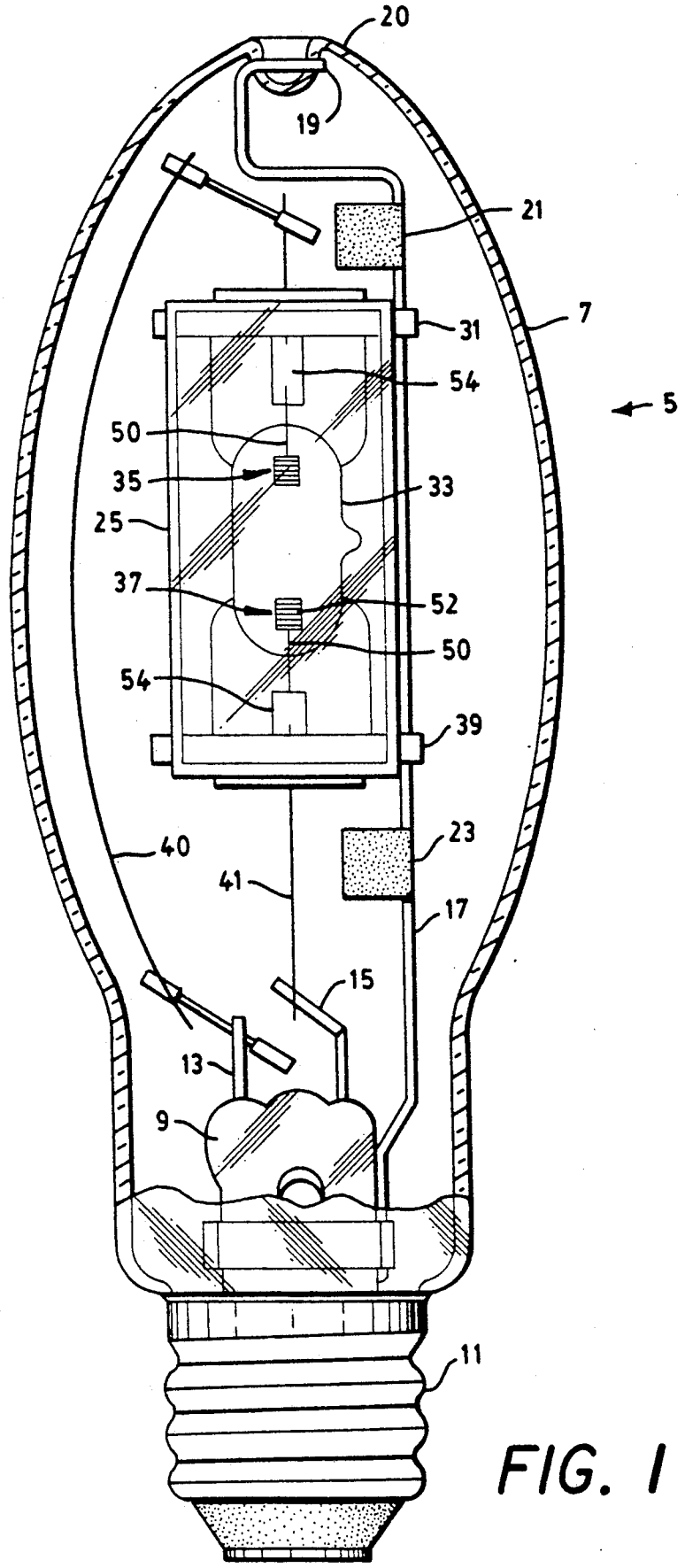
FIG. 1 is a cross-sectional view of a metal halide discharge lamp made in accordance with the present invention.

Referring to FIG. 1 of the drawings, there is shown an example of a most preferred embodiment of a lamp in accordance with the present invention. The illustrated lamp 5 includes a quartz discharge tube 33 (also referred to herein as "arc tube") disposed within an outer sealed glass envelope 7. The outer envelope is most preferably evacuated, although the outer envelope of a lamp of the present invention need not be evacuated. The outer envelope 7 is hermetically sealed to a glass stem member 9 having an external base member 11 affixed thereto. A pair of electrical conductors 13 and 15 are sealed into and pass through the stem member 9 and provide access for energization of the discharge lamp by an external source (not shown).

Within the outer envelope 7, a support member 17 is secured to the glass stem member 9 and extends substantially parallel to the longitudinal axis of the lamp and forms a circular configuration 19 near the upper portion of the envelope. The circular configuration 19 in conjunction with a dimpled upper portion 20 of the envelope 7 tends to maintain the support structure 17 in proper alignment and resistant to deformation caused by external shock.

A radiating shield 25 is supported from the support structure 17 by means of a first strap member 31 and a second strap member 39. The first and second strap members 31 and 39 are welded to the support member 17 so as to extend therefrom in a direction normal to the longitudinal axis and the direction of the support member 17. The first and second strap members 31 and 39 are spaced apart from each other along the longitudinal axis of the lamp by a distance selected according to the length dimension of a radiating shield 25 so as to provide maximum support therefor.

Within the radiating shield 25 is the discharge tube 33. The arc tube 33 is connected to the support member 17 by means of metal strap members (not shown) which are affixed to the outer surface of the arc tube 33. The arc tube 33 has a pinch seal at each end thereof. A pair of electrodes 35 and 37 are sealed into the pinch seals of the discharge tube and project into the interior of the discharge tube 33. The electrodes are connected to metal foil members 54, preferably comprising molybdenum, which are sealed into the press seals. The electrode 35 is mechanically and electrically coupled to a wire conductor 40, which is in turn connected to conductor 13. The electrode 37 is affixed to an electrical conductor 41 which is electrically and mechanically connected to electrical conductor 15. Further details regarding the construction of low wattage metal halide lamps are included in U.S. Pat. Nos. 4,620,125 and 4,625,141, which are hereby incorporated herein by reference.

The electrodes 35 and 37 comprise tungsten containing thorium oxide, also known as thoriated tungsten. The thorium oxide content in each electrode is preferably not substantially greater than about 2% by weight.

Each electrode 35, 37 includes an electrode rod 50 of thoriated tungsten and a tungsten electrode coil 52 mounted near one end of electrode rod 50. The coil 52 typically does not contain thoria. The other end of the electrode rod 50 is attached to a molybdenum ribbon 54. The electrode is mounted in the arc tube 33 so that the coil 52 is located in the discharge region, and the ribbon (also referred to herein as foil) 54 is located in the press seal region.

A pair of getters 21 and 23 are affixed to the support structure 17 and serve to provide and maintain the vacuum within the evacuated outer envelope 7 in accordance with a most preferred embodiment of the invention. The discharge tube for use in a 100 watt size lamp, for example, typically has an internal diameter of 10 mm and an arc length of 14 mm.

A single ended design (shown in FIG. 1) with a mogul type base, e.g., an E27 screw base, facilitates universal lamp operation with the full output rating in all burning positions and a life rating of 10,000 hours. The lamp may alternatively have a double-ended configuration (not shown) with a recessed single-contact base.

In the embodiment shown in FIG. 1, the support structure 17 comprises an electrically conductive "floating-frame", which means that the frame is electrically isolated from the lamp's circuit. As set forth in the foregoing description of FIG. 1, the frame 17 also supports the radiation shield 25 which surrounds the discharge tube 33. Such radiation shield is typically a quartz sleeve which can be open at one or both ends. When an end is closed it typically has a domed configuration.

The "floating-frame" structure design is used to control the sodium loss from the arc tube fill by interrupting the electrical circuit between the frame and electrical conductors, arc tube electrodes, and external power source (not shown). The "floating-frame" structure provides electrical isolation between the radiation shield/arc tube support structure and the external circuit, resulting in the frame and shield floating at a positive potential thereby reversing the sodium electrolysis process. The features and advantages of the "'floating-frame" structure are described in more complete detail in co-pending U.S. patent application Ser. No. 814,140 of Robert S. White and James C. Morris, filed Dec. 27, 1985, for "Low Wattage Metal Halide Discharge Lamp" and assigned to the Assignee of the present application, which application is hereby incorporated herein by reference.

As shown in FIG. 1 and briefly described above, a most preferred embodiment of the lamp of the present invention includes a transparent radiation shield 25 of fused quartz which surrounds the arc tube (to capture and return thermal radiation to the arc tube) and the radiation shield is immersed in vacuum (to eliminate heat conduction losses from the shield). The diameter and length of the radiation shield are chosen with respect to the arc tube dimensions to achieve the optimal radiation redistribution resulting in uniform arc tube wall temperatures. See, for example, U.S. patent application Ser. No. 351,286 of Keeffe et al. for "Double-Enveloped Lamp Having A Shield Surrounding A Light-Source Capsule Within A Thick-Walled Outer Envelope", filed May 5, 1989, which is a continuation of Ser. No. 090,983 filed Aug. 28, 1987, and U.S. Pat. No. 4,791,334 of Keeffe et al. for "Metal-Halide Lamp Having Heat Redistribution Means", filed May 7, 1987, the disclosures of which is hereby incorporated herein by reference.

The discharge tube 33 contains a chemical fill in accordance with the present invention, which is at least partially vaporized during lamp operation.

In dispensing the chemical fill into the arc tube of a lamp of the present invention, the non-gaseous components of the fill are preferably dispensed into the unsealed arc tube prior to introduction of the starting gas and carbon monoxide additive. In a most preferred method of fabrication, the starting gas and carbon monoxide are premixed to a predetermined CO concentration level and introduced into the arc tube in a single step, after which the arc tube is "tipped off". The lamp is otherwise fabricated by conventional lamp processing techniques.

The following examples are provided to enable those skilled in this art to more clearly understand and practice the present invention. These examples should not be construed as a limitation upon the scope of the present invention but merely as being illustrative and representative thereof.

EXPERIMENTAL

Twenty-seven 100-watt metal halide lamps were made to compare lamps of the present invention with lamps not including a carbon monoxide additive as a component of the chemical fill of the lamp. Each of the twenty-seven lamps tested included the lamp structure described in U.S. Pat. No. 4,620,125 for "Low Wattage Metal Halide Lamp With Inverted Domed Sleeve", issued to Keeffe et al. on Oct. 28, 1988, the disclosure of which is hereby incorporated herein by reference. Each of the lamps included a quartz arc tube having an internal volume of 1.3 $cm^3$. The fill of each arc tube included 16 mg Hg, 12 mg of a multicomponent anhydrous mixed salt comprising 86 weight percent sodium iodide, 10.1 weight percent scandium triiodide, 3.9 weight percent cesium iodide, and 0.13 mg of scandium metal. Fifteen of the lamps (Lamp Group A) were filled with 100 torr of argon gas and sealed off as a control group. At the same time, four of remaining lamps (Lamp Group B) were filled with 100 torr of a mixture of argon and 0.05% CO by volume and sealed off. Another group of four remaining lamps (Lamp Group C) was filled with 100 torr of an argon +0.15% CO mixture. Finally, the last group of four remaining lamps (Lamp Group D) was filled with 100 torr of an argon +0.5% CO mixture. The argon including the specified volume amounts of CO was obtained from Matheson Gas Products, 61 Grove Street, Gloucester, MA.

The four test groups were the same in all respects save one, namely the CO concentration: 0%, 0.05%, 0.15%, and 0.5% by volume. The specific fills included in the arc tubes of the four lamp groups tested are summarized in Table I below.

TABLE I

| | CHEMICAL FILL | | | | | | |
|---|---|---|---|---|---|---|---|
| LAMP GROUP | Hg (mg) | NaI (mg) | $ScI_3$ (mg) | CsI (mg) | Sc (mg) | Ar (torr) | CO (vol %) |
| A | 16 | 10.3 | 1.6 | 0.6 | 0.13 | 100 | 0 |
| B | 16 | 10.3 | 1.6 | 0.6 | 0.13 | 100 | 0.05 |
| C | 16 | 10.3 | 1.6 | 0.6 | 0.13 | 100 | 0.15 |
| D | 16 | 10.3 | 1.6 | 0.6 | 0.13 | 100 | 0.5 |

The four Lamp Groups were tested for 3,000 hours at rated wattage on a standard cycle of ten hours on and two hours off. The lumen output was measured at 100, 500, 1,000, 2,000, and 3,000 hours at rated wattage on a standard reference ballast circuit. The resulting percent lumen maintenance referenced to the initial 100-hour reading is plotted in FIG. 2 as a function of the percent CO addition for 500, 1,000, 2,000, and 3,000 hours.

Based on the results of the lamp testing, an example of a most preferred CO level for the arc tube chemical fill is 0.15% by volume. After 500 hours of operation, lamps including 0.15% by volume CO in the fill afforded a lumen-maintenance improvement of 5.8% when compared with the pure argon controls.

Figure 2:
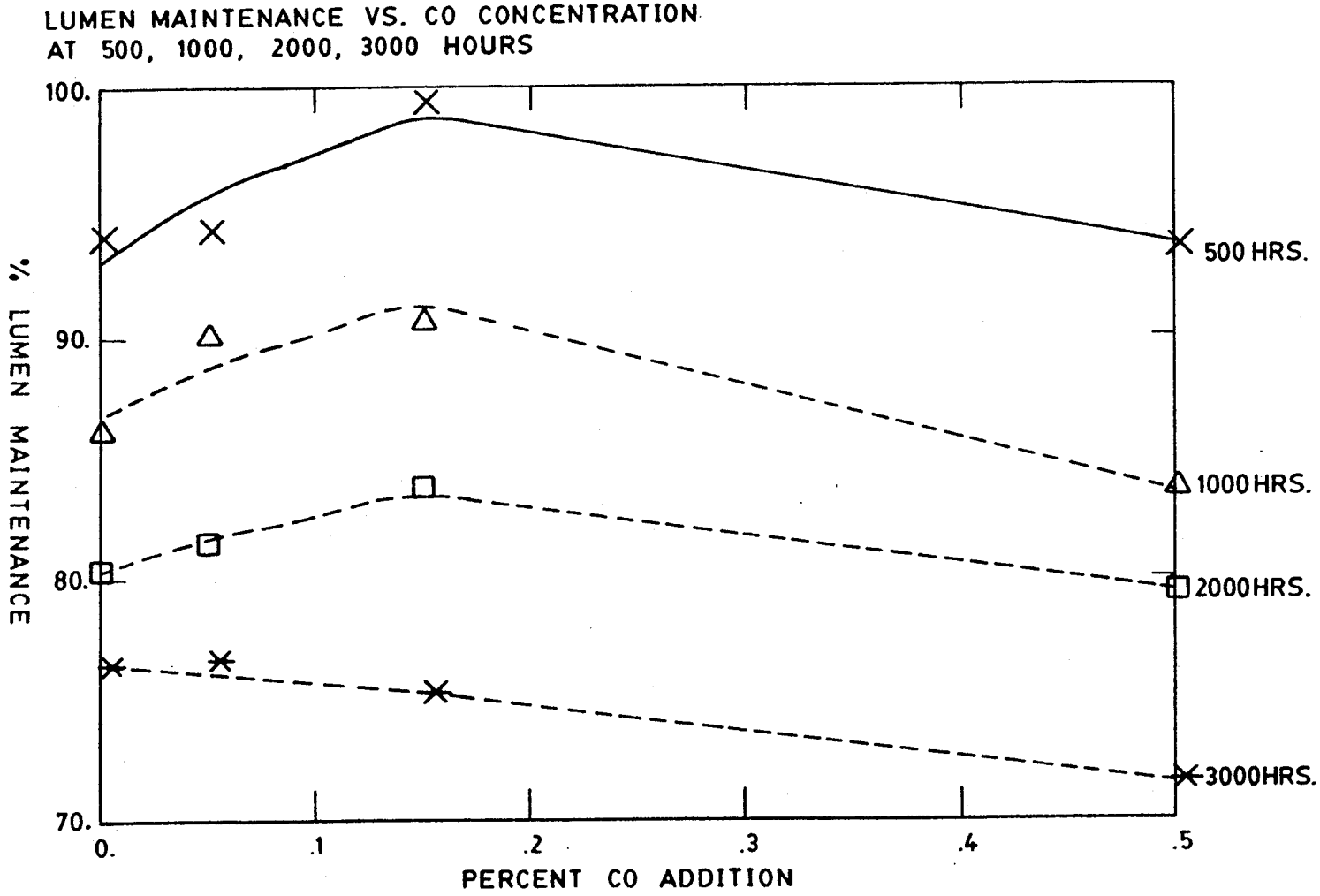
FIG. 2 graphically illustrates lumen maintenance as a function of the amount of CO (vol %) included in the lamp fill for lamps of the present invention.

The lumen-maintenance improvement for lamps of the present invention is readily apparent in the 1,000 and 2,000 hour curves of FIG. 2.

While there has been shown and described what at present is considered the preferred embodiment of this invention, it will be apparent to those skilled in the art that various changes and modifications may be made therein without departing from the invention as defined by the appended claims.

What is claimed is:

1. A metal halide discharge lamp comprising:
an outer sealed glass envelope;
a pair of electrical conductors sealed into and passing through the glass envelope;
an arc tube disposed within the outer glass envelope, the arc tube (having a volume of 0.3–2.2 $cm^3$ and) including a pair of spaced electrodes therein with the electrodes being electrically connected to the electrical conductors such that one electrode is electrically connected to one electrical conductor;
a chemical fill disposed within the arc tube, said chemical fill consisting essentially of about 12 $mg/cm^3$ mercury; about 0.1 $mg/cm^3$ scandium metal; about 1 $mg/cm^3$ scandium iodide; about 8 $mg/cm^3$ sodium iodide; about 0.4 $mg/cm^3$ cesium iodide; 100 torr starting gas; and greater than zero, but less than 0.5% carbon monoxide by volume; and
a support structure disposed within the outer glass envelope to support the arc tube therein.

2. A low wattage metal halide discharge lamp comprising:
an outer sealed glass envelope;
a pair of electrical conductors sealed into and passing through the glass envelope;
an arc tube disposed within the outer glass envelope, the arc tube including a pair of spaced electrodes therein with the electrodes being electrically connected to the electrical conductors such that one electrode is electrically connected to one electrical conductor;
a chemical fill disposed within the arc tube, the chemical fill consists essentially of about 12 $mg/cm^3$ mercury, about 0.1 $mg/cm^3$ scandium metal, about 1 $mg/cm^3$ scandium iodide, about 8 $mg/cm^3$ sodium iodide, about 0.4 $mg/cm^3$ cesium iodide, 100 torr starting gas, and carbon monoxide;
a support structure disposed within the outer glass envelope to support the arc tube therein, the support structure being electrically isolated from the electrical circuit of the lamp; and
a radiation shield supported from the support structure such that it surrounds the arc tube.

3. A low wattage metal halide discharge lamp in accordance with claim 2 wherein said carbon monoxide additive is present in said fill in an amount greater than zero to approximately 0.5% by volume.

4. A low wattage metal halide discharge lamp in accordance with claim 3 wherein said carbon monoxide additive is present in said fill in an amount from approximately 0.1 to approximately 0.2% by volume.

5. A low wattage metal halide discharge lamp in accordance with claim 3 wherein said lamp has a wattage of 40 to 150 watts.

6. A low wattage metal halide discharge lamp in accordance with claim 4 wherein said arc tube has a wall loading in the range of about 14 to 17 watts/$cm^2$.

7. A low wattage metal halide discharge lamp in accordance with claim 4 wherein said scandium metal is present in a weight dosage of about 90 to 110 micrograms per cubic centimeter.

8. A low wattage metal halide discharge lamp in accordance with claim 4 wherein said mercury is present in a weight dosage in accordance with the formula: $N(Hg)\ (mg/cm^3)=7.7D^{1/7}$ wherein D is the arc tube diameter in millimeters.

9. A low wattage metal halide lamp in accordance with claim 2 wherein said carbon monoxide additive is present in an amount of approximately 0.15% by volume.

* * * * *